United States Patent [19]

Takeda et al.

[11] Patent Number: 4,908,665

[45] Date of Patent: Mar. 13, 1990

[54] DEVELOPER CARRIER CONTAINING ELECTRICALLY CONDUCTIVE FILLER PRESENT IN A RESIN COATING LAYER FOR USE IN DRY-TYPE IMAGE DEVELOPING DEVICE

[75] Inventors: Fuchio Takeda, Tokyo; Kazuo Nojima, Numazu; Yasutaka Nakamura, Tokyo, all of Japan

[73] Assignee: Ricoh Company, Ltd., Tokyo, Japan

[21] Appl. No.: 159,282

[22] Filed: Feb. 23, 1988

[30] Foreign Application Priority Data

Feb. 23, 1987 [JP] Japan ..... 62-39614

[51] Int. Cl.[4] ..... G03G 15/06; G03G 15/08; G03G 9/08

[52] U.S. Cl. ..... 355/245; 118/653; 29/132; 430/120; 355/259

[58] Field of Search ..... 355/3 DD, 14 D, 245, 355/259; 118/651, 656, 652, 653, 657, 658; 29/130, 132; 430/120

[56] References Cited

U.S. PATENT DOCUMENTS

| | | | |
|---|---|---|---|
| 4,444,864 | 4/1984 | Takahashi | 118/653 X |
| 4,564,285 | 1/1986 | Yasuda et al. | 355/14 D X |
| 4,696,255 | 9/1987 | Yano et al. | 355/3 DD X |

FOREIGN PATENT DOCUMENTS

| | | | |
|---|---|---|---|
| 0033152 | 3/1978 | Japan | 430/111 |
| 0012927 | 1/1980 | Japan | 430/120 |
| 0208769 | 12/1983 | Japan | 355/3 DD |
| 0080876 | 5/1985 | Japan | 355/3 DD |
| 0247669 | 12/1985 | Japan | 355/3 DD |
| 0173273 | 8/1986 | Japan | 355/3 DD |
| 0070877 | 4/1987 | Japan | 355/3 DD |
| 0070879 | 4/1987 | Japan | 355/3 DD |

*Primary Examiner*—A. T. Grimley
*Assistant Examiner*—Ed Pipala
*Attorney, Agent, or Firm*—Oblon, Spivak, McClelland, Maier & Neustadt

[57] ABSTRACT

A developer carrier is used in a dry-type image developing device employing a one-component developer in an electrophotographic copier or an electrostatic recording apparatus. The developer carrier has a resin coating layer including an electrically conductive filler dispersed therein which is made of a material having a volume resistivity of at most 100 Ωcm. With this arrangement, the range in which the resistance of the surface layer varies under the ambient condition of varying temperature and humidity is small, producing a copy of stable image quality free from a smeared or contaminated background.

8 Claims, 2 Drawing Sheets

DEVELOPER CARRIER CONTAINING ELECTRICALLY CONDUCTIVE FILLER PRESENT IN A RESIN COATING LAYER FOR USE IN DRY-TYPE IMAGE DEVELOPING DEVICE

BACKGROUND OF THE INVENTION

1. Field of the Invention:

The present invention relates to a developer carrier for use in a dry-type image developing device which employs a one-component developer in an electrophotographic copier or an electrostatic recording apparatus.

2. Description of the Prior Art:

There is known a developer carrier such as a developing roller having an electrically insulative resin layer around the peripheral surface thereof, the developer carrier being used as a means for bringing a one-component developer into contact with an electrostatic latent image on an electrostatic latent image carrier such as a photosensitive drum to develop the electrostatic latent image into a visible image. In order to remove an electric residual image from the developer layer on the developer carrier after the image development, the resin layer on the developer carrier must be made of a material exhibiting strong polarity such as urethane, epoxy, or the like which is of relatively high electric conductivity. The electric conductivity of these materials greatly varies as ambient conditions such as temperature and humidity vary, failing to provide stable image developing characteristics.

There is also known a developer carrier having a resin layer made of highly insulative acrylic resin, for example, the resin layer having a plurality of electrodes scattered as islands therein, each of the electrodes being of a size larger than the diameter of a developer particle. With this type of developer carrier, if an inverse bias voltage applied to a lightly charged developer is high, charges are moved from the electrodes to the developer for thereby producing a developer charged in opposite polarity, with the result that the amount of the developer consumed is increased.

It has been found that the image developing characteristics vary due to changes in the electric resistance of the resin layer on the developer carrier which are caused by absorption of moisture into the resin and dispersion of moisture from the resin.

SUMMARY OF THE INVENTION

It is an object of the present invention to provide a developer carrier for use in a dry-type image developing device employing a one-component developer, the developer carrier being arranged to solve the aforesaid problems of the conventional developer carriers.

According to the present invention, a developer carrier for use in a dry-type image developing device has a resin coating surface layer with an electrically conductive filler being dispersed therein, the electrically conductive filler being made of a material having a volume resistivity of 100 Ω cm or less. With this arrangement, the range in which the resistance of the surface layer varies under the ambient condition of varying temperature and humidity is small, producing a copy of stable image quality free from a smeared or contaminated background.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
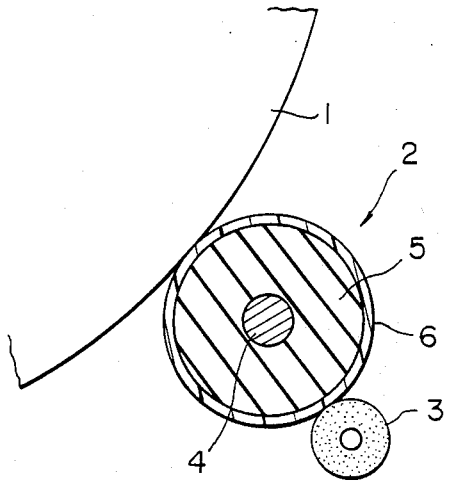
FIG. 1 is a transverse cross-sectional view of a developer carrier according to the present invention, the developer carrier being shown as being incorporated in a dry-type image developing device.
Figure 2:
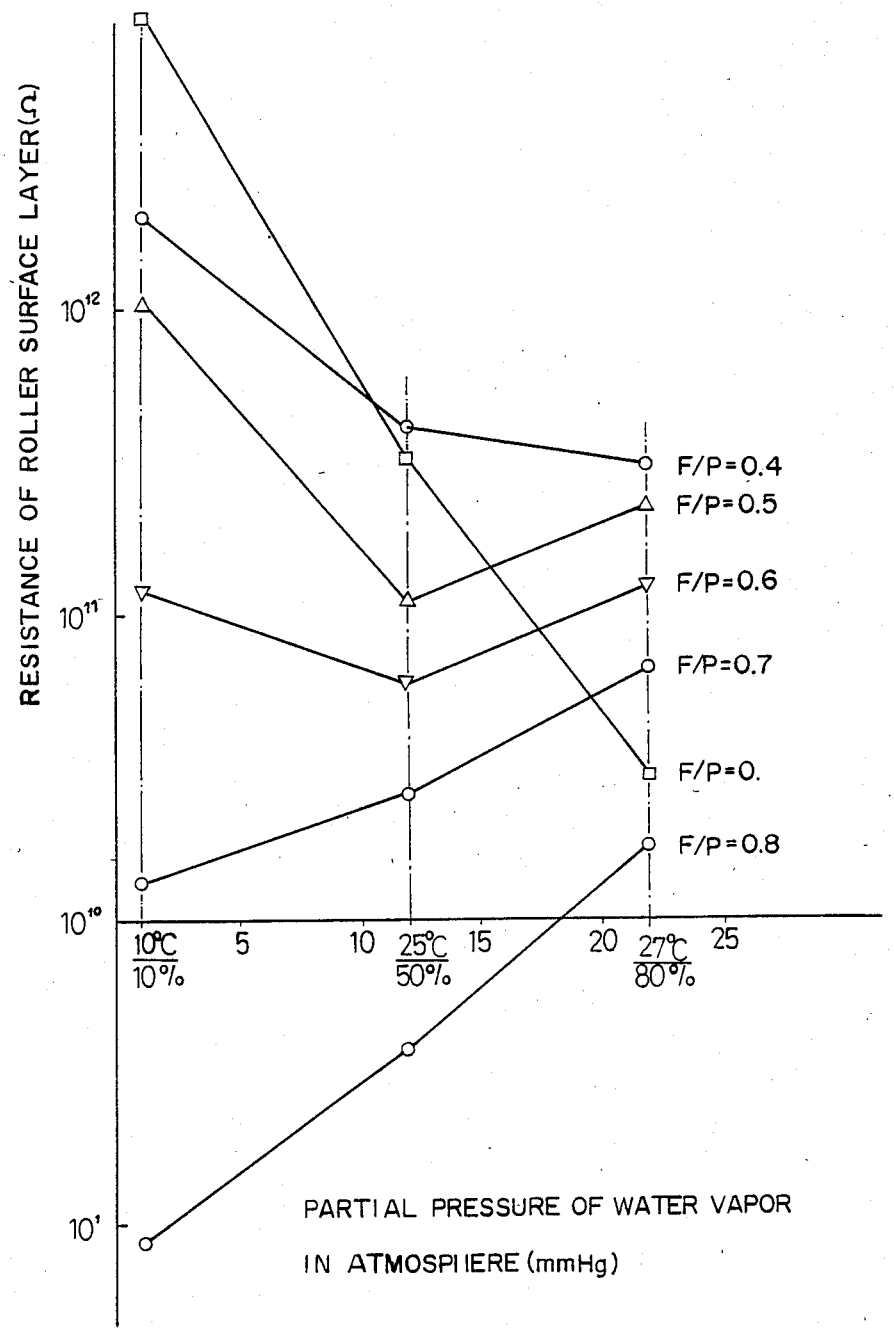
FIG. 2 is a graph showing the relationship between filler/resin ratios and surface layer resistances.

As shown in FIG. 1, a dry-type image developing device has a photosensitive drum or latent image carrier 1 for carrying on its circumferential surface an electrostatic latent image formed by electrophotography. The electrostatic latent image is developed into a visible image by a one-component developer supplied by a developing roller or developer carrier 2. The developing roller 2 is supplied with the one-component developer by a sponge rubber roller 3 which is capable of triboelectrically charging the developer. The one-component developer used comprises toner having electric resistance which is high enough to be triboelectrically charged.

The developing roller 2 comprises a core shaft 4, a rubber layer 5 on the circumferential surface of the core shaft 4, and a resin coating layer 6 on the circumferential surface of the rubber layer 5. The core shaft 4 has a diameter of 8 mm. The rubber layer 5 has a thickness of 6 mm and is made of acrylonitrile rubber (NBR rubber). The resin coating layer 6 has a thickness ranging from 5 to 100 micrometers and is made of filler-dispersed resin comprising polyester-urethane with a filler having a volume average particle diameter of 1 micrometer or less being dispersed therein at a filler/polyester-urethane ratio in the range of from 0.10 to 1.6.

An electrostatic latent image on the photosensitive drum 1 is developed in contact with the resin coating layer 6 of the developing roller 2. The rubber layer 5 is effective in keeping the photosensitive drum 1 which is substantially a rigid body and the developing roller 2 in good contact with each other.

Examples of developer carriers will be described below:

EXAMPLE 1

A filler of TiO (Titanblack, 20M manufactured by Mitsubishi Metal Corp.) having a volume average particle diameter of 1 micrometer or less and a volume resistivity of 100 Ω cm or less was dispersed in polyester-urethane at a filler/polyester-urethane ratio of 1.4 to provide a resin coating layer having a thickness of 30 micrometers. The resin coating layer thus fabricated was mounted on an NBR rubber roller to produce a developer carrier.

EXAMPLE 2

A filler of $SnO_2$ (containing $Sb_2O_3$) having a volume average particle diameter of 1 micrometer or less and a volume resistivity of 100 Ω cm or less was dispersed in polyester-urethane at a filler/polyester-urethane ratio of 0.6 to provide a resin coating layer having a thickness of 30 micrometers. The resin coating layer thus fabricated was mounted on an NBR rubber roller to produce a developer carrier.

The material $SnO_2$ (containing $Sb_2O_3$) is a resistive material which is a metal oxide semiconductor having a positive temperature coefficient (PTC) of (Ω) of the surface layer of the developing roller varies with respect to the partial pressure (mmHg) of water vapor in atmosphere when the ratio of the electrically conductive filler comprising $SnO_2$ (containing $Sb_2O_3$) and the polyester-urethane (F/R) changes from 0.4 to 0.8. The graph shows that the resistance of the roller surface layer varies sharply when the F/R ratio is 0 and 0.8. No desired object can be achieved when the F/R ratio is 0 and 0.8 or higher. The F/R ratio range from 0.5 to 0.7 is preferable.

If the F/R ratio becomes higher, the electrical properties of the electrically conductive filler becomes more dominant, making the resin coating layer lower in resistance under the ambient conditions of low temperature and low humidity, whereas if the F/R ratio is relatively low, the resin coating layer exhibits higher resistance at low temperature and low humidity.

The same results can be obtained by selecting the F/R ratio to range from 0.5 to 0.7 for combinations of the electrically conductive filler and other resins such as urethanes such as acrylic urethane, fluoroplastics, or epoxy resins. Thus, a resin coating layer which is less dependent on the ambient conditions can be obtained. These effects are also exhibited by generally known superconductive materials. However, the optimum F/R ratio thereof may slightly deviate from the range of 0.5 to 0.7 dependent on the combination of materials used.

EXAMPLE 3

A filler of carbon black (Blackpearl L, #400 manufactured by Cabot Plastics Limited) having a volume average particle diameter of 1 micrometer of less and a volume resistivity of 100 Ωcm or less was dispersed in polyester-urethane at a filler/polyester-urethane ratio of 0.13 to provide a resin coating layer having a thickness of 30 micrometers. The resin coating layer thus fabricated was mounted on an NBR rubber roller to produce a developer carrier.

When the developer carriers according to the above Examples were left for 24 hours at 10° C. and 15%RH, the surface layer resistance of the developer carriers was about $1 \times 10^{12}$ ohms. No background smearing or contamination was observed in reversal development when the potential of an image area on the electrostatic latent image carrier was −200V, the potential of a non-image area (background) on the electrostatic latent image carrier was −900 V, and a bias voltage of −500 V was applied to the developer carrier. Even when a bias voltage of −850 V was applied to the developer carrier and the potential difference between the developer carrier and the background area, i.e., the developing potential difference, was reduced to 50 V, no background smearing or contamination was caused.

When the ratio between the electrically conductive filler and the polyester-urethane was lower than the values indicated in the Examples given above, the surface layer resistance of the developer carrier exceeded $10^{12}$ ohms, resulting in background smearing or contamination. When the ratio was higher than the values in the Examples, the surface layer resistance of the developer carrier was lower than $1 \times 10^9$ ohms, also giving rise to background smearing or contamination.

Any background smearing or contamination produced when the surface layer resistance of the developer carrier exceeded $1 \times 10^{12}$ ohms could be reduced to a certain extent by regulating the bias voltage applied to the developer carrier. However, it was difficult to reduce background smearing or contamination caused when the surface layer resistance of the developer carrier was below $1 \times 10^9$ ohms, by regulating the bias voltage applied to the developer carrier. This appears to result from the fact that electric charges move from the developer carrier which is of a relatively low surface layer resistance to the developer thereby to invert the charging polarity of the developer.

The surface of a thin layer of the one-component developer formed on the developer carrier should preferably be as smooth as possible. Therefore, the thickness of the resin coating layer of the developer carrier should be greater than the volume average particle diameter of the electrically conductive filler. The volume average diameter of the electrically conductive filler should be equal to or less than the volume average particle diameter of the developer, or preferably equal to or less than ¼ thereof.

Although a certain preferred embodiment has been shown and described, it should be understood that many changes and modifications may be made therein without departing from the scope of the appended claims.

What is claimed is:

1. A developer carrier for use in a dry-type image developing device having an electrostatic latent image carrier for carrying an electrostatic latent image that can be developed into a visible image by contact with a one-component developer, said developer carrier comprising: a developer carrier body having a circumferential surface; and a resin coating layer mounted on said circumferential surface, said resin coating layer including an electrically conductive filler having a volume average particle diameter which is equal to or less than ¼ of the average particle diameter of the developer dispersed therein, and electrically conductive filler being made of a material having a volume resistivity of at most 100 Ω cm.

2. A developer carrier for use in a dry-type image developing device having an electrostatic latent image carrier for carrying an electrostatic latent image that can be developed into a visible image by contact with a one-component developer, said developer carrier comprising: a developer carrier boy having a circumferetial surface; and a resin coating layer mounted on said circumferential surface, said resin coating layer including an electrically conductive filler dispersed therein, said electrically conductive filler being made of a material having a volume resistivity of at most 100 Ω cm, wherein said electricity conductive filler comprises electrically conductive particles made of a resistive metal oxide semiconductor material having a material added thereto so as to have a positive temperature coefficient of resistance.

3. The developer carrier of claim 2, wherein said resin coating layer has a thickness which is equal to or greater than the volume average particle diameter of said electrically conductive filler.

4. The developer carrier of claim 3, wherein said electrically conductive filler has a volume average particle diameter which is equal to or less than the average particle diameter of the developer.

5. The developer carrier of claim 2, wherein said electrically conductive filler has a volume average particle diameter which is equal to or less than the average particle diameter of the developer.

6. The developer carrier of claim 5, wherein said electrically conductive filler has a volume average particle diameter which is equal to or less than $\frac{1}{4}$ of the average particle diameter of the developer.

7. The developer carrier of claim 5, wherein said resin coating layer has a thickness which is equal to or greater than the volume average particle diameter of said electrically conductive filler.

8. The developer carrier of claim 4, wherein said electrically conductive filler has a volume average particle diamter which is equal to or less than $\frac{1}{4}$ of the average particle diameter of the developer.

* * * * *